US010082371B2

(12) United States Patent
Atluri et al.

(10) Patent No.: US 10,082,371 B2
(45) Date of Patent: Sep. 25, 2018

(54) CONTAINERIZED TUBULAR SHOOTING RANGE

(71) Applicant: ZEN TECHNOLOGIES LIMITED, Hyderabad (IN)

(72) Inventors: Ashok Atluri, Hyderabad (IN); Ravi Kumar Midathala, Hyderabad (IN)

( * ) Notice: Subject to any disclaimer, the term of this patent is extended or adjusted under 35 U.S.C. 154(b) by 0 days.

(21) Appl. No.: 15/514,378

(22) PCT Filed: Sep. 26, 2015

(86) PCT No.: PCT/IB2015/057407
§ 371 (c)(1),
(2) Date: Mar. 24, 2017

(87) PCT Pub. No.: WO2016/046807
PCT Pub. Date: Mar. 31, 2016

(65) Prior Publication Data

US 2017/0292818 A1 Oct. 12, 2017

(30) Foreign Application Priority Data

Sep. 27, 2014 (IN) ..... 4794/CHE/2014

(51) Int. Cl.

| | |
|---|---|
| ***F41J 11/00*** | (2009.01) |
| ***F41J 9/02*** | (2006.01) |
| ***F41J 5/14*** | (2006.01) |
| ***F41J 13/00*** | (2009.01) |

(52) U.S. Cl.
CPC ..... *F41J 11/00* (2013.01); *F41J 5/14* (2013.01); *F41J 9/02* (2013.01); *F41J 13/00* (2013.01)

(58) Field of Classification Search
CPC ..... F41J 11/00; F41J 11/02
USPC ..... 273/404, 410
See application file for complete search history.

(56) References Cited

U.S. PATENT DOCUMENTS

| | | | | | |
|---|---|---|---|---|---|
| 2,356,992 | A | * | 8/1944 | Gilson | F41J 13/00 188/269 |
| 2,535,280 | A | * | 12/1950 | Gartrell | F41J 1/01 273/404 |
| 2,670,959 | A | * | 3/1954 | Broyles | F41J 11/00 273/406 |
| 4,164,901 | A | * | 8/1979 | Everett | F41J 11/00 273/410 |
| 4,509,301 | A | * | 4/1985 | Head | E04H 1/125 273/404 |
| 4,598,631 | A | * | 7/1986 | Everett | F41J 11/00 273/348 |

(Continued)

*Primary Examiner* — Mark Graham
(74) *Attorney, Agent, or Firm* — James M. Smedley LLC; James Michael Smedley, Esq.

(57) ABSTRACT

The present disclosure relates to a shooting range which is movable or transportable so as to enable it to be operated at different locations as desired. The shooting range disclosed comprises of at least one open ended tubular element, a target assembly comprising at least one target and is placed at a rear end of the tubular element. The shooting range comprises of a wall means placed behind the target for resisting penetration by projectiles and to inhibit rebounding of projectiles there from. The shooting range comprises of a plurality of supporting frames for holding the open ended tubular element and wall means and further comprises a tray at the bottom of the wall means for collecting the residues.

20 Claims, 11 Drawing Sheets

(56) References Cited

U.S. PATENT DOCUMENTS

| | | | | | |
|---|---|---|---|---|---|
| 4,683,688 | A * | 8/1987 | Wojcinski | E04B 1/34336 | 273/404 |
| 5,088,741 | A * | 2/1992 | Simonetti | F41J 11/00 | 273/406 |
| 5,577,733 | A * | 11/1996 | Downing | F41J 1/10 | 250/222.2 |
| 5,907,930 | A * | 6/1999 | Ricco, Sr. | F41J 11/02 | 273/404 |
| 6,162,057 | A * | 12/2000 | Westphal | F41J 11/00 | 434/11 |
| 7,967,296 | B1 * | 6/2011 | Halverson | F41J 11/00 | 273/404 |
| 8,459,651 | B1 * | 6/2013 | Nester | F41J 13/00 | 273/410 |

* cited by examiner

CONTAINERIZED TUBULAR SHOOTING RANGE

CROSS-REFERENCE TO RELATED APPLICATIONS

This application is a National Stage of PCT International Application No. PCT/IB2015/057407, filed on Sep. 26, 2015, and published in English on Mar. 31, 2016 as WO 2016/046807, which claims priority to Indian Application No. 4794/CHE/2014 filed on Sep. 27, 2014, each of which are hereby expressly incorporated herein by reference in their entirety.

TECHNICAL FIELD OF THE INVENTION

The present disclosure relates to a containerized tubular shooting range assembly used for indoor/outdoor shooting practices.

BACKGROUND OF THE INVENTION

In order to maintain proficiency in the use of firearms, it is common for armed forces like the police and sportsmen to engage in target practice. While target practice has traditionally been conducted on a range in which targets were placed a distance away from the shooter, many have realized that such a scenario does not adequately train officers for many real life situations. Long ago live birds, particularly pigeons, were used to simulate actual shooting situations. Due to the expense and inconvenience involved in gathering a sufficient number of live birds to facilitate worthwhile practice, artificial targets, commonly referred to as a "clay pigeons", were substituted for live birds. Today, shooters frequently use facilitates known as skeet, trap, sporting clays, etc., to hone their shooting skills.

Regardless of whether artificial targets are utilized to practice for shooting or for targeting shooting competitions, finding a venue suitable for artificial target shooting can be problematic. Real or imagined problems such as danger to people and property from arrant projectiles, air and water pollution, noise pollution, etc. virtually rule out artificial target shooting in heavily populated urban areas. Parcels of land of sufficient size and suitable location to facilitate artificial target shooting activities are often prohibit ably expensive even when located 100 miles or more from centres of urban areas. For these reasons fewer and fewer shooters are able to find artificial target shooting facilities that they can afford.

A similar circumstance presents itself to police and military personnel. Obviously, such individuals must practice on a continuous basis in order to be prepared when an armed combat situation arises. Because the handguns and long guns used in police and military combat have much longer ranges as compared with shotguns, projectile containment is an absolute necessity. This fact together with real or imagined concerns over air and water pollution and noise pollution virtually rule out police and military shooting practice in areas that are even remotely close to civilian populations. Also, in shooting practice for the military and police personnel indoor/outdoor shooting practices are provided by constructing such shooting equipment's in remote premises, for such shooting practice. In such shooting practice there is always a risk of participants and unauthorized persons walking in the danger zone who can get injured from accidental misfires. Also, construction of such shooting sites is expensive and also involves rental expenses for such premises.

It has been known to provide shooting ranges which are installed inside enclosed building structures or the like. A disadvantage of such shooting ranges is that they are stationary. Also, the cost of operating such ranges is high because of the necessary rental of premises.

Therefore there is a need to develop a shooting range arrangement system used for indoor/outdoor shooting practices to overcome the limitations sated above.

SUMMARY OF THE INVENTION

The following presents a simplified summary of the disclosure in order to provide a basic understanding to the reader. This summary is directed towards a containerized shooting range assembly for indoor/ outdoor shooting range practices.

It is an object of the present invention to provide a shooting range which is movable or transportable so as to enable it to be operated at different locations as desired.

According to an aspect of the present invention, a shooting range in an open or in an enclosed area comprises of at least one open ended tubular element, a target assembly comprising at least one target and is placed at a rear end of the tubular element.

In accordance with an aspect of the present invention, the shooting range comprises of a wall means placed behind the target for resisting penetration by projectiles and to inhibit rebounding of projectiles there from. The shooting range comprises of a plurality of supporting frames for holding the open ended tubular element and wall means.

In accordance with an aspect of the present invention, the shooting range further comprises a tray at the bottom of the wall means for collecting the residues. And, the wall means comprises one or more of a rubber brick wall, a steel wall, a fibre glass panel and a sand bag.

In accordance with an aspect of the present invention, the open ended tubular element is made of non-penetratable material like armoured steel.

In accordance with an aspect of the present invention, the shooting range further comprises of a cabin with at least one platform at a front end that accommodates at least one shooter for his shooting practice, The cabin is provided with a pair of doors for gaining access to the said cabin. The cabin is also provided with a lighting means, ventilation means comprising one or more exhaust aids and air compressing vents to mitigate the gases created in the cabin due to shooting.

In accordance with an aspect of the present invention, the shooting range further comprises of a plurality of sidewalls containing a plurality of impenetrable layers to arrest larger portion of the noise that arise from the tubular element.

In accordance with an aspect of the present invention, the cabin further comprises of one or more compartments each facilitating access to a shooter.

In accordance with an aspect of the present invention, the open ended tubular elements characterized to have a means to adjust the platform as desired by the shooter.

In accordance with an aspect of the present invention, the supporting frames are further characterized into plurality of partitions of square or rectangular shapes for holding and supporting the said tubular elements.

In accordance with an aspect of the present invention, the target retrieval units used by the shooters characterized to have priorities like a desired target, a desired distance of the target and a means for verifying a hit location on the target by taking the target out of the tube when desired.

In accordance with an aspect of the present invention, the target holder is further characterized to hold the target in suspended position to the steel wire and is driven to and fro towards the shooter by using the rope and the motor is disclosed.

In accordance with an aspect of the present invention, the target means further comprises of a projectile detection unit equipped to the target assembly for detecting the hit location of the projectile on the target.

In accordance with an aspect of the present invention, the target means comprises of firing point equipment placed at the firer end to receive the projectile hit or miss location from the projectile detection unit.

In accordance with an aspect of the present invention, the firing point is characterized to compute and display the location of hit in terms of plurality of coordinates while displaying an aggregate score of the shooter on a screen associated.

In accordance with an aspect of the present invention, the walls of the shooting range are absorbent walls that resist penetration of projectiles.

BRIEF DESCRIPTION OF THE DRAWINGS

The accompanying drawings, which are incorporated in and constitute a part of this disclosure, illustrate exemplary embodiments and, together with the description, serve to explain the disclosed principles. In the figures, the left-most digit(s) of a reference number identifies the figure in which the reference number first appears. The same numbers are used throughout the figures to reference like features and components. Some embodiments of system and/or methods in accordance with embodiments of the present subject matter are now described, by way of example only, and with reference to the accompanying figures, in which.

Figure 1:
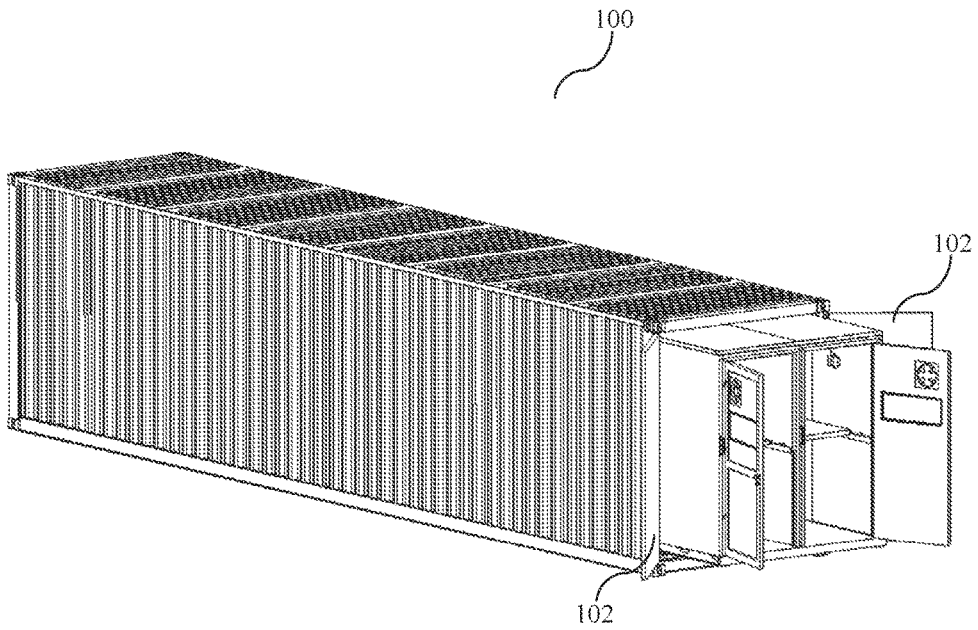
FIG. 1 illustrates a front perspective view of the containerized tubular shooting range assembly according to the present invention.

It should be appreciated by those skilled in the art that any block diagrams herein represent conceptual views of illustrative systems embodying the principles of the present subject matter. Similarly, it will be appreciated that any flow charts, flow diagrams, state transition diagrams, pseudo code, and the like represent various processes which may be substantially represented in computer readable medium and executed by a computer or processor, whether or not such computer or processor is explicitly shown.

DETAILED DESCRIPTION OF THE INVENTION

In the following description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented herein. It will be readily understood that the aspects of the present disclosure, as generally described herein, and illustrated in the figures, can be arranged, substituted, combined, and designed in a wide variety of different configurations, all of which are explicitly contemplated and make part of this disclosure.

In the present document, the word "exemplary" is used herein to mean "serving as an example, instance, or illustration." Any embodiment or implementation of the present subject matter described herein as "exemplary" is not necessarily to be construed as preferred or advantageous over other embodiments.

While the disclosure is susceptible to various modifications and alternative forms, specific embodiment thereof has been shown by way of example in the drawings and will be described in detail below. It should be understood, however that it is not intended to limit the disclosure to the particular forms disclosed, but on the contrary, the disclosure is to cover all modifications, equivalents, and alternative falling within the spirit and the scope of the disclosure.

The terms "comprises", "comprising", or any other variations thereof, are intended to cover a non-exclusive inclusion, such that a setup, device or method that comprises a list of components or steps does not include only those components or steps but may include other components or steps not expressly listed or inherent to such setup or device or method. In other words, one or more elements in a system or apparatus proceeded by "comprises . . . a" does not, without more constraints, preclude the existence of other elements or additional elements in the system or apparatus.

In accordance to an exemplary embodiment of the present invention, a shooting range which is movable or transportable so as to enable it to be operated at different locations as desired is disclosed.

In accordance to an exemplary embodiment of the present invention, a shooting range in an open or in an enclosed area comprises of at least one open ended tubular element, a target assembly comprising at least one target and is placed at a rear end of the tubular element.

In accordance to an exemplary embodiment of the present invention, the shooting range comprises of a wall means placed behind the target for resisting penetration by projectiles and to inhibit rebounding of projectiles there from. The shooting range comprises of a plurality of supporting frames for holding the open ended tubular element and wall means.

In accordance to an exemplary embodiment of the present invention, the shooting range further comprises a tray at the bottom of the wall means for collecting the residues. And, the wall means comprises one or more of a rubber brick wall, a steel wall, a fibre glass panel and a sand bag.

In accordance to an exemplary embodiment of the present invention, the open ended tubular element is made of non-penetratable material like armoured steel.

In accordance to an exemplary embodiment of the present invention, the shooting range further comprises of a cabin with at least one platform at a front end that accommodates at least one shooter for his shooting practice, The cabin is provided with a pair of doors for gaining access to the said cabin. The cabin is also provided with a lighting means, ventilation means comprising one or more exhaust aids and air compressing vents to mitigate the gases created in the cabin due to shooting.

In accordance to an exemplary embodiment of the present invention, the shooting range further comprises of a plurality of sidewalls containing a plurality of impenetrable layers to arrest larger portion of the noise that arise from the tubular element.

In accordance to an exemplary embodiment of the present invention, the cabin further comprises of one or more compartments each facilitating access to a shooter.

In accordance to an exemplary embodiment of the present invention, the open ended tubular elements characterized to have a means to adjust the platform as desired by the shooter.

In accordance to an exemplary embodiment of the present invention, the supporting frames are further characterized into plurality of partitions of square or rectangular shapes for holding and supporting the said tubular elements.

In accordance to an exemplary embodiment of the present invention, the target retrieval units used by the shooters characterized to have priorities like a desired target, a desired distance of the target and a means for verifying a hit location on the target by taking the target out of the tube when desired.

In accordance to an exemplary embodiment of the present invention, the target holder is further characterized to hold the target in suspended position to the steel wire and is driven to and fro towards the shooter by using the rope and the motor is disclosed.

In accordance to an exemplary embodiment of the present invention, the target means further comprises of a projectile detection unit equipped to the target assembly for detecting the hit location of the projectile on the target.

In accordance to an exemplary embodiment of the present invention, the target means comprises of firing point equipment placed at the firer end to receive the projectile hit or miss location from the projectile detection unit.

In accordance to an exemplary embodiment of the present invention, the firing point is characterized to compute and display the location of hit in terms of plurality of coordinates while displaying an aggregate score of the shooter on a screen associated.

In the following description of the embodiments of the disclosure, reference is made to the accompanying drawings that form a part hereof, and in which are shown by way of illustration specific embodiments in which the disclosure may be practiced. These embodiments are described in sufficient detail to enable those skilled in the art to practice the disclosure, and it is to be understood that other embodiments may be utilized and that changes may be made without departing from the scope of the present disclosure. The following description is, therefore, not to be taken in a limiting sense.

FIG. 1 illustrates an assembly that comprises a containerized tubular shooting range 100 in accordance with an exemplary embodiment of the present invention. The container 100 comprises of plurality of side walls illustrating a pair of doors 102 of the front opening for gaining access to the cabin.

Figure 2:
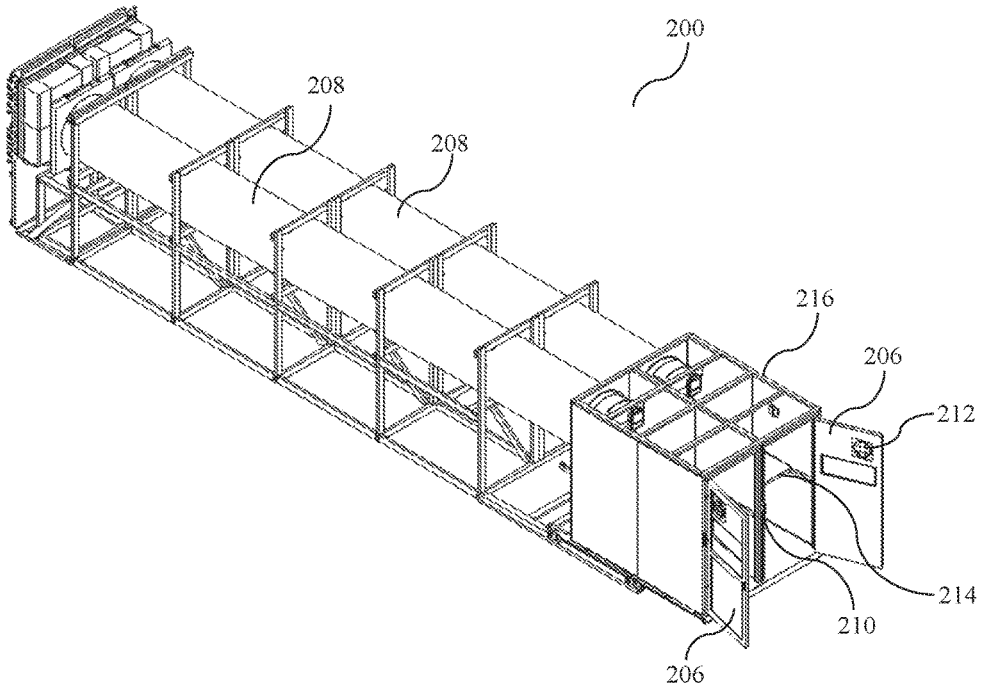
FIG. 2 illustrates a front perspective view of the containerized tubular shooting range assembly without a container and a cabin top according to the present invention.

FIG. 2 illustrates two tubular elements along with a cabin enclosure 200 at the front opening according to the present invention. The cabin enclosure is provided with a plurality of doors 206 for gaining access to the cabin section attached with a cabin ventilation means such as fans 212 with a cabin handle 210 at its centre, where the cabin section can be divided into compartments having at least one platform 214 for accommodating at least one shooter for his practice. This platform 214 can be adjusted in height and orientation according to the requirement of the shooter. The cabin section is also provided with a plurality of side walls 216 forming a closed enclosure. Longitudinal tubular elements 208 are placed in conjunction with the cabin for assisting the shooter for facilitating the best shooting practices.

Figure 3:
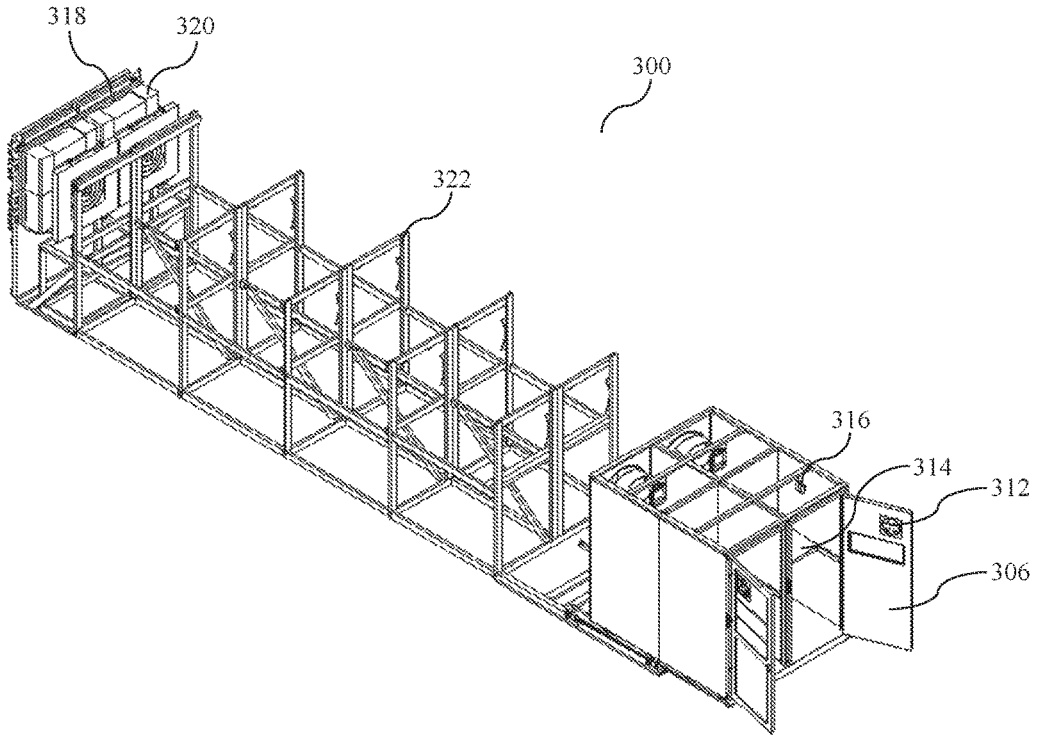
FIG. 3 illustrates a front perspective view of plurality of supporting frames of the tubular shooting range assembly without container, cabin top and hidden tubes according to the present invention.

FIG. 3 illustrates a front perspective view 300 of containerized shooting range with a plurality of supporting frames, a plurality of accessible doors 306 and a ventilation means such as a fan 312 for assisting the shooter for his shooting practice. A platform 314 is provided in support of the shooter at the time of shooting. At the rear end of the cabin section, there provided a plurality of supporting frames 322, for holding the open ended tubular elements 208 as shown in FIG. 2 which is further divided into plurality of partitions of square or rectangular shapes for holding and supporting the open ended tubular elements 208.

Figure 7:
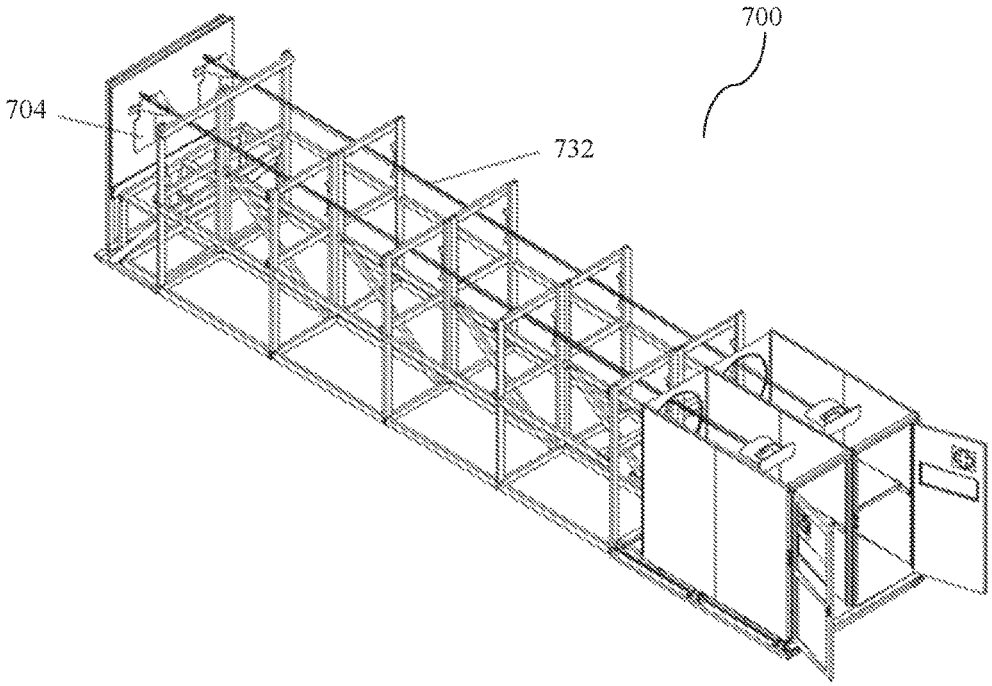
FIG. 7 illustrates a front perspective view of the containerized tubular shooting range provided with a target means according to the present invention.

At the rear end of the container, an absorbent wall 318 is provided which can be a rubber wall placed behind the targets as shown in FIG. 7. Behind the absorbent wall 318, a steel wall 320 is arranged to stop any off-target bullets and shells that come through inner walls of the open ended tubular elements. This absorbent wall 318 and the steel wall 320 can also resist penetration by projectiles and to inhibit rebounding of projectiles there from.

Figure 4:
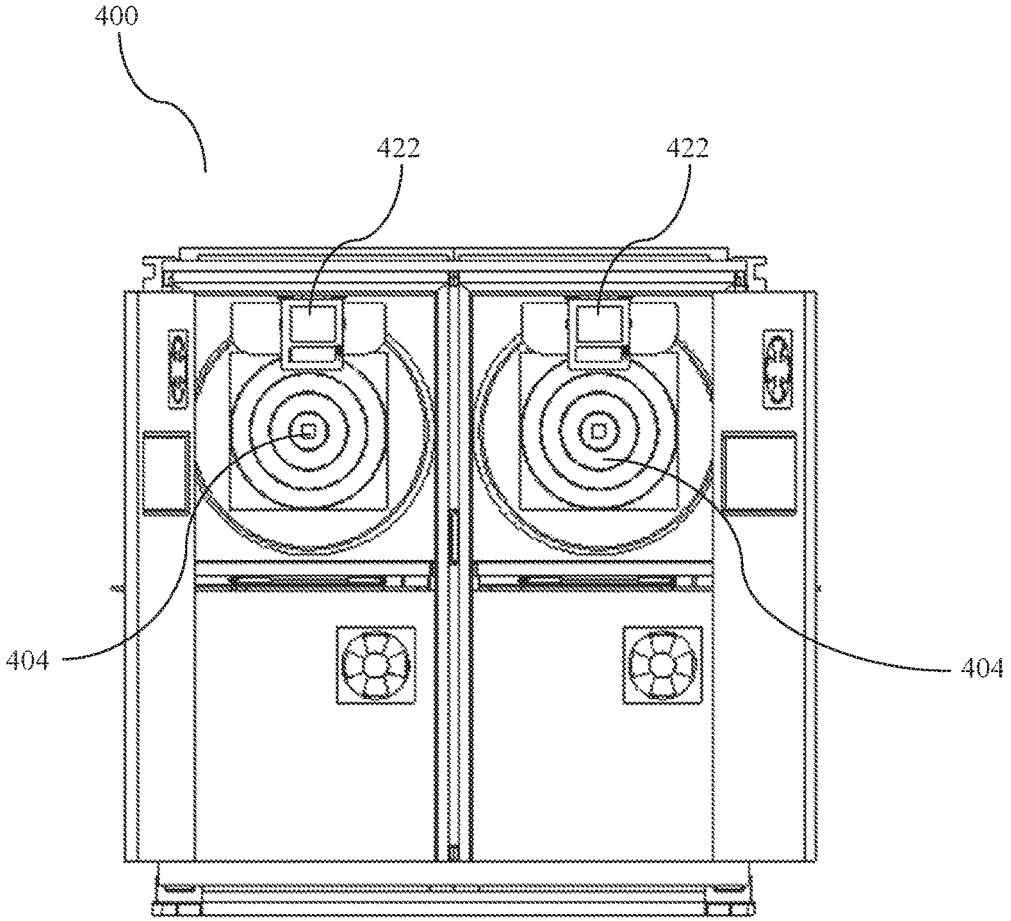
FIG. 4 illustrates a front view of the containerized tubular shooting range assembly according to the present invention.

FIG. 4 illustrates a front view 400 of the containerized tubular shooting range. A target means 404 at the top of which are placed on a frame that is operated using a motor, a steel rope, a target holder and a target interval unit available in the chain. Further, the target means 404 is provided with priorities like a desired target, a desired position of the target and a means for verifying a hit location on the target by taking the target out of the tube. Firing point equipment 422 is provided to compute and display the location of hit in terms of a plurality of coordinates along while displaying an aggregate score of the shooter.

The target 404 is suspended to a steel wire and is driven to and fro towards and backwards the shooter by using a rope and a motor. A projectile detection unit equipped to the target assembly is detects a hit location of the projectile on the target. Firing point equipment 422 is placed at the shooter end to receive the projectile hit location from the projectile detection unit.

Figure 5:
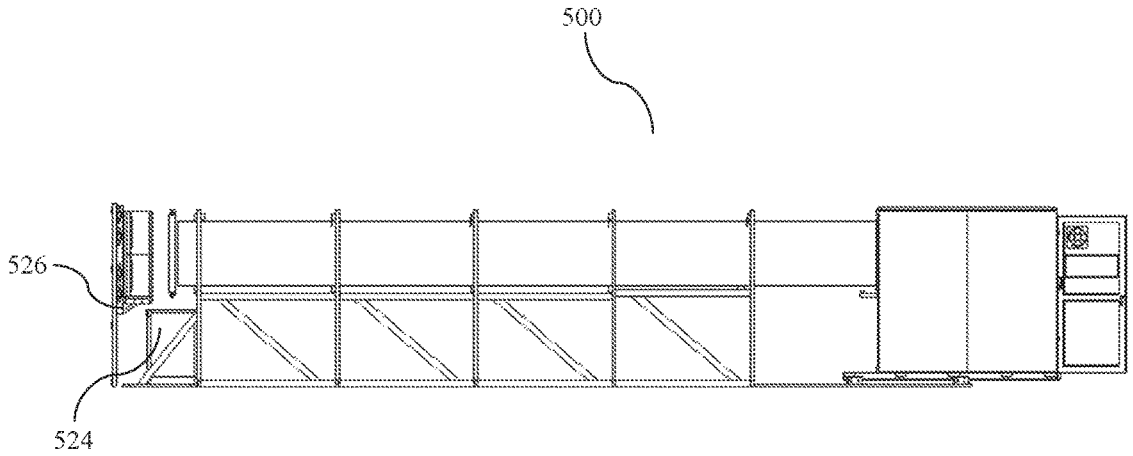
FIG. 5 illustrates a side view of the containerized tubular shooting range assembly without container according to the present invention.

FIG. 5 illustrates a side view 500 of the shooting range container. At the rear end of the container, there arranged a lighting means 524 and a tray 526 for collecting the off-target bullets coming through the open ended tubular elements.

Figure 6:
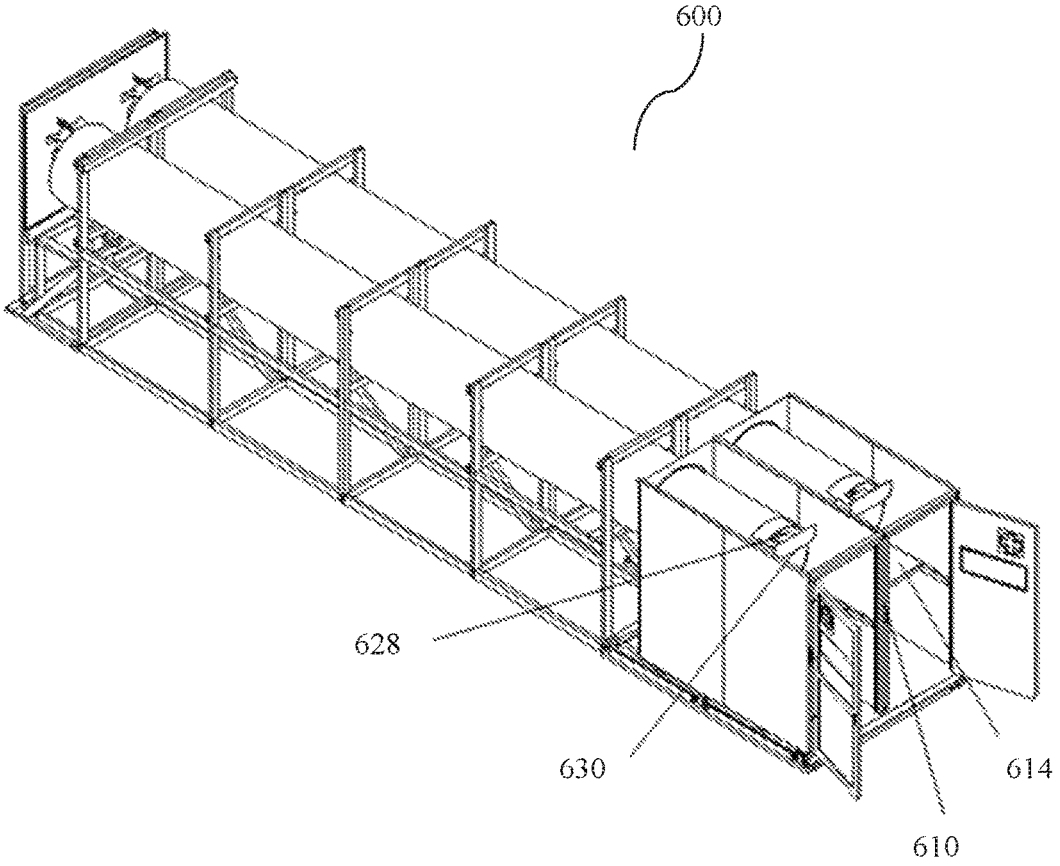
FIG. 6 illustrates a front perspective view of the containerized shooting range with cabin elements according to the present invention.

FIG. 6 illustrates a front perspective view 600 of the container provided with the motor 628 and a motor supporting means 630 to operate the target assemblies on top of the cabin section provided with a handle 610 and an adjustable platform 614 for accommodating a shooter. As shown in the FIG. 7, it illustrates a front view of the container with a steel wire 732 connected between the target 704 and the motor means provided at the front end of the tubular element to hold the target 704 and drive to and fro towards the shooter by using the steel wire 732 and the motor as shown in FIG. 6.

Figure 8:
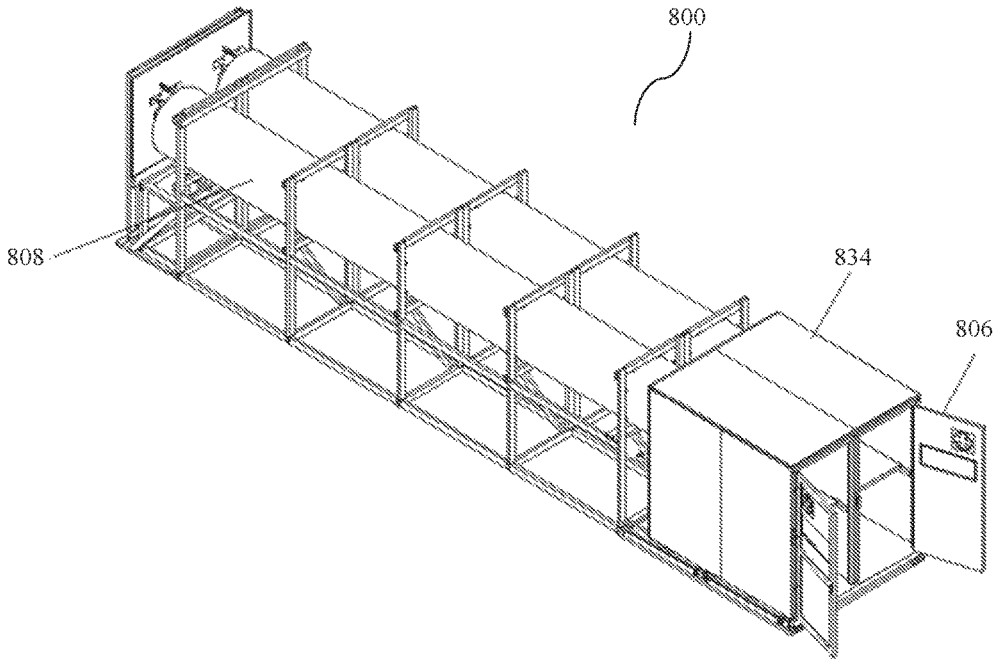
FIG. 8 illustrates a front perspective view of the cabin assembly and tubular elements of the shooting range assembly according to the present invention.
Figure 9:
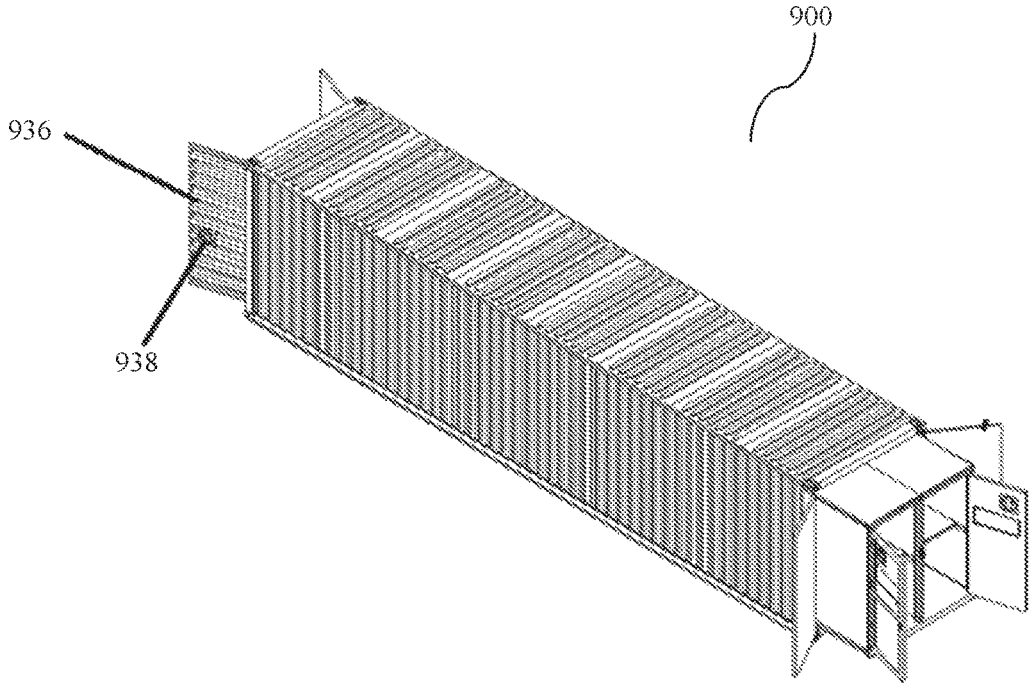
FIG. 9 illustrates a front perspective view of the tubular shooting range assembly with a plurality of doors according to the present invention.

FIG. 8 illustrates a perspective view 800 of cabin assembly provided with top walls 834 providing a closed enclosure with a pair of accessing doors 806 accommodating at least one tubular element 808. The container provided with a pair of rear doors 936 along with fans 938 for ventilating as shown in FIG. 9, are placed inner side of the container and the cabin section.

Figure 10:
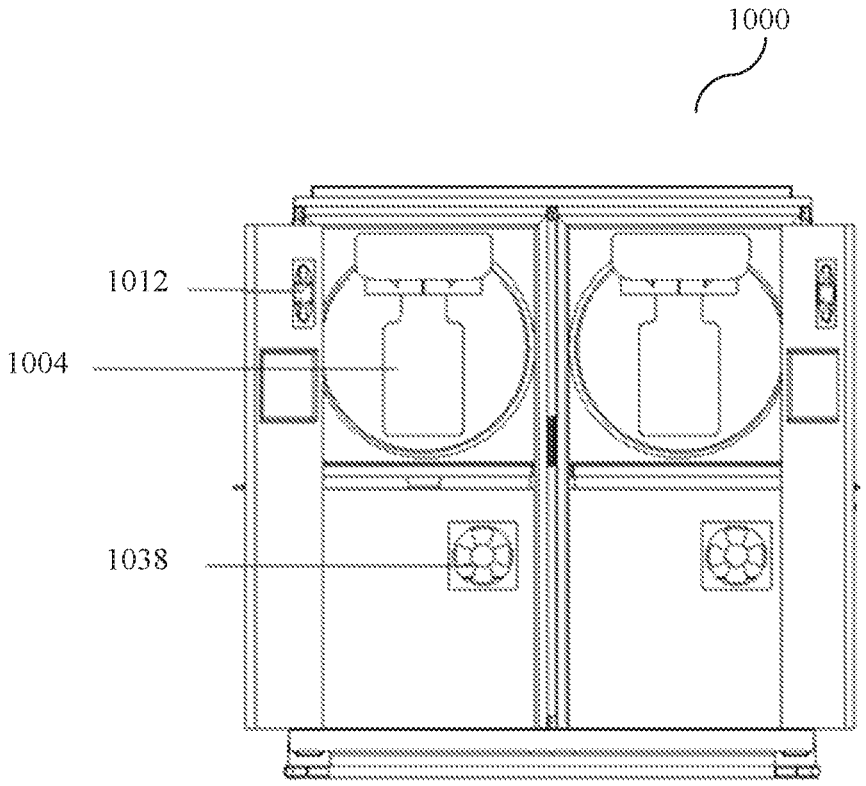
FIG. 10 illustrates a front view of containerized shooting range with a target means and ventilation means according to the present invention.
Figure 11:
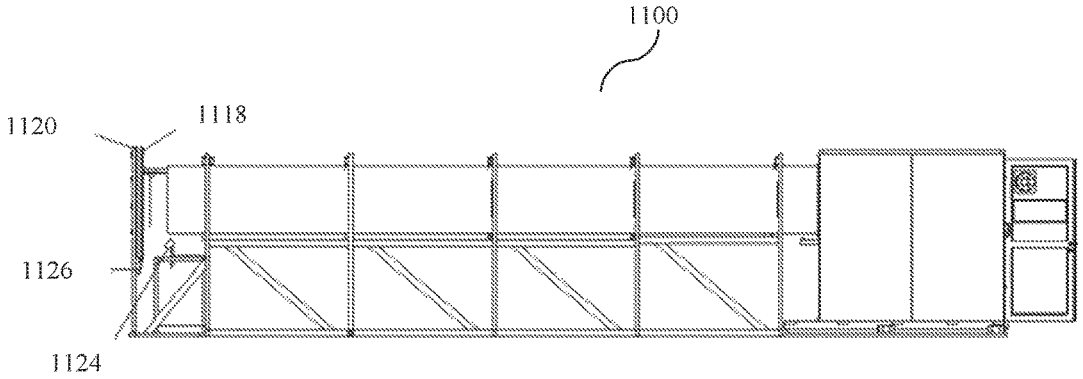
FIG. 11 illustrates a side view of the containerized tubular shooting range according to the present invention.

FIG. 10 illustrates a front view 1000 of the container provided with fan 1038 and 1012 arranged on the doors of the cabin section in accordance with an exemplary embodiment of the invention. FIG. 11 illustrates a side view 1100 of the container equipped with illumination means 1124, a tray 1126 for collecting the off-target bullets and shells, an absorbent wall 1118 and a steel wall 1120 for resisting and projecting the projectiles there from.

In this respect, it is to be understood that the embodiments in this application are not limited to the assemblies set forth in the description or illustrated in the drawings. Additional benefits and advantages of the present embodiments will become apparent in those skilled in the art to which the embodiments relate from the description of the preferred embodiment and the appended claims, taken in conjunction with the accompanying drawings. It is important, therefore, that the claims be regarded as including such assemblies insofar as they do not depart from the spirit and scope of the embodiments described herein.

What is claimed is:

1. An arrangement for a shooting range, comprising:
- a container;
- an open ended tubular element disposed in the container;
- at least one target assembly comprising at least one target, placed at a rear end of the open ended tubular element;
- a wall assembly placed behind the target for resisting penetration by projectiles and to inhibit rebounding of the projectiles there from; and
- a plurality of supporting frames supported by the container, each of the plurality of supporting frames having a member on which the open ended tubular element directly rests, each member forming part of an aperture of each supporting frame;
- wherein the open ended tubular element extends through the aperture of each of the plurality of supporting frames.

2. The arrangement as claimed in claim 1, further comprising a tray at the bottom of the wall assembly for collecting residues.

3. The arrangement as claimed in claim 1, wherein the wall assembly includes one or more of the following:
- a rubber brick wall;
- a steel wall;
- a fiber glass panel; and
- a sand bag.

4. The arrangement as claimed in claim 1, wherein the shape of the open ended tubular element is circular.

5. The arrangement as claimed in claim 1, wherein the open ended tubular element is made of non-penetratable material.

6. The arrangement as claimed in claim 1, wherein the open ended tubular element is made of armoured steel.

7. The arrangement as claimed in claim 1, further comprising:
- a cabin with at least one platform at a front end that accommodates at least one shooter;
- a pair of doors for gaining access to the said cabin;
- a lighting assembly; and
- a ventilation assembly comprising one or more exhaust aids and air compressing vents to mitigate the gases created in the cabin due to shooting.

8. The arrangement as claimed in claim 7, further comprising a plurality of sidewalls containing a plurality of impenetrable layers to arrest larger portion of the noise that arise from the tubular element.

9. The arrangement as claimed in claim 7, further comprising a plurality of compartments each facilitating access to a shooter.

10. The arrangement as claimed in claim 7, wherein the at least one platform is an adjustable platform.

11. The arrangement as claimed in claim 1, wherein each of the plurality of supporting frames include a plurality of partitions of square or rectangular shapes for holding and supporting the said tubular element and said wall assembly.

12. The arrangement as claimed in claim 1, wherein the target assembly includes:
- a motor;
- steel wire; and
- a target holder to hold the target in suspended position to the steel wire and is driven to and fro towards the shooter by using the steel wire and the motor.

13. The arrangement as claimed in claim 1, wherein the target assembly includes a projectile detection unit placed at the rear end for detecting the hit location of the projectiles on the target and a firing point equipment placed at a front end of the open ended tubular element to receive the projectile hit or miss location from the projectile detection unit.

14. The arrangement as claimed in claim 13, wherein the firing point equipment is configured to compute and display the location of hits in terms of a plurality of coordinates along with an aggregate score of the shooter.

15. The arrangement as claimed in claim 1, wherein the arrangement is a gunnery training arrangement, a target practicing arrangement, or a gaming arrangement.

16. A containerized arrangement for a shooting range in an open or in an enclosed area, comprising:
- a container;
- an open ended tubular element disposed in the container;
- a plurality of supporting frames supported by the container, each of the plurality of supporting frames having a member on which the open ended tubular element directly rests, each member forming part of an aperture of each supporting frame;
- at least one target assembly that includes a plurality of targets at a rear end of the open ended tubular element;
- a cabin with at least one platform at a front end that accommodates at least one shooter;
- a pair of doors for gaining access to the said cabin;
- a ventilation assembly including one or more exhaust aids and air compressing vents to mitigate the gases created in the cabin due to shooting;
- an absorbent wall behind the test targets;
- a steel frame behind the absorbent wall to stop any off-target bullets and shells that come through the inner walls of the open ended tubular elements; and a tray between the absorbent wall and the steel frame to collect residues;

wherein the open ended tubular element extends through the aperture of each of the plurality of supporting frames.

17. The containerized arrangement as claimed in claim 16, wherein the open ended tubular element is a circular open ended tubular element.

18. An apparatus, comprising:

a container;

a first and second open ended housing disposed in the container;

at least one target assembly including at least one target, disposed at a rear end of each open ended housing;

a wall assembly placed behind the target for resisting penetration by projectiles and to inhibit rebounding of projectiles there from; and a plurality of supporting frames supported by the container, each of the plurality of supporting frames having a first aperture and a second aperture;

wherein the first open ended housing extends through the first aperture of each of the plurality of supporting frames; and wherein the second open ended housing extends through the second aperture of each of the plurality of supporting frames.

19. The apparatus of claim 18, wherein the wall assembly includes one or more of the following:

a rubber brick wall;

a steel wall;

a fiber glass panel; and a sand bag.

20. The apparatus as claimed in claim 18, wherein the first and second open ended housings are circular open ended housings.

* * * * *